US005667137A

United States Patent [19]

Dupre

[11] Patent Number: 5,667,137

[45] Date of Patent: Sep. 16, 1997

[54] ICE AND SNOW-FREE SNOW MAKING TOWER STRUCTURE

[76] Inventor: Herman K. Dupre, c/o Seven Springs, Champion, Pa. 15622

[21] Appl. No.: 521,946

[22] Filed: Aug. 31, 1995

[51] Int. Cl.[6] ..... F25C 3/04

[52] U.S. Cl. ..... 239/14.2; 239/139

[58] Field of Search ..... 239/14.2, 128, 239/139

[56] References Cited

U.S. PATENT DOCUMENTS

| | | | |
|---|---|---|---|
| 3,408,005 | 10/1968 | Struble et al. | 239/14 |
| 3,761,020 | 9/1973 | Tropeano et al. | 239/2 S |
| 3,762,176 | 10/1973 | Coggins, Jr. | 62/74 |
| 3,822,825 | 7/1974 | Dupre | 239/14 |
| 3,829,013 | 8/1974 | Ratnik | 239/14 |
| 3,908,903 | 9/1975 | Burns, Jr. | 239/2 S |
| 3,923,247 | 12/1975 | White | 239/14 |
| 3,952,949 | 4/1976 | Dupre | 239/2 S |
| 3,957,203 | 5/1976 | Bullard | 239/128 |
| 3,964,682 | 6/1976 | Tropeano et al. | 239/2 S |
| 4,101,073 | 7/1978 | Curran | 239/14 |
| 4,199,103 | 4/1980 | Dupre | 239/14.2 |
| 4,480,788 | 11/1984 | Manhart | 236/14 |
| 4,919,331 | 4/1990 | Kosik, Sr. et al. | 239/2.2 |
| 5,004,151 | 4/1991 | Dupre | 239/14.2 X |
| 5,360,163 | 11/1994 | Dupre | 239/14 |

FOREIGN PATENT DOCUMENTS 2208471 8/1990 Japan .

*Primary Examiner*—Andres Kashnikow
*Assistant Examiner*—Steven J. Ganey
*Attorney, Agent, or Firm*—Carothers & Carothers

[57] ABSTRACT

An adjustable snow making tower structure which includes a device for warming the tower structure for preventing ice and snow buildup and for precooling the water before it is supplied to the tower for manufacturing snow. The snow making tower is usually an elongated pipe configuration which is secured at its lower end to the support arm, and the snow making nozzles are provided at the upper end of the pipe tower. The support arm is utilized for raising and lowering the pipe tower between horizontal to vertical. The support arm is made of heat conducting tubing and is connected to a remote water supply and is connected for conveying water under pressure through the tubing of the support arm to the bottom end of the pipe tower. Accordingly the water being conveyed through the support arm warms the support arm and is precooled prior to being conveyed to the snow making nozzles at the top of the tower to provide better quality snow with greater efficiency. During operation, the support arm remains snow and ice-free due to the warming effects of the water passing therethrough.

13 Claims, 3 Drawing Sheets

ICE AND SNOW-FREE SNOW MAKING TOWER STRUCTURE

BACKGROUND OF THE INVENTION

This invention relates generally to the art of fluid sprinkling and more particularly to snow making towers for ski slopes.

The present invention pertains to an improvement in adjustable snow making towers of the type disclosed in the present inventor's U.S. Pat. No. 5,360,163 issued Nov. 1, 1994.

A suitable discussion regarding prior art background of the present invention is presented in this patent and also in the inventor's U.S. Pat. No. 3,822,825, issued Jul. 9, 1974 and U.S. Pat. No. 3,952,949, issued Apr. 27, 1976. Accordingly the background provided in these patents is incorporated herein by reference.

Generally, the present invention pertains to adjustable snow making towers which are comprised of a vertical support pole and a support arm pivotally connected to the support pole adjacent the upper end thereof for pivotal movement from vertical to horizontal. A snow making pipe tower is secured at its lower end to the support arm and is provided with snow making nozzle mechanisms at the upper end thereof.

This pipe tower is supported from the support arm for elevating the nozzles above ground with pivotal movement of the support arm toward vertical. Remote air and water supplies are connected to the pipe water tower to provide water and air under pressure to the nozzle mechanisms at the upper end of the pipe tower for discharge into ambient atmosphere for manufacturing snow in subfreezing conditions.

The snow making pipe tower, which is supported on the support arm for movement between horizontal and vertical, may be of the type wherein water and air under pressure are mixed at the base of the pipe tower, or are independently conveyed through the pipe tower as disclosed in the inventor's above-referenced patents.

The problem encountered with such adjustable prior art snow making towers is that ice and snow buildup on the tower structure and also the water under pressure being supplied to the snow tower is warmer than desired. The resultant effect is that ice and snow buildup must be periodically removed or the tower will be destroyed by the weight of the ice accumulation and also quality snow cannot be manufactured at higher subfreezing ambient temperatures.

It is a principal object of the present invention to provide an adjustable snow making tower which is free from ice and snow accumulation thereon and provides colder water to the tower for the manufacture of better quality snow at higher ambient subfreezing temperatures.

SUMMARY OF THE INVENTION

To accomplish these objectives, the adjustable snow making tower of the present invention includes an adjustable support arm, which is constructed of heat conducting tubing, such as aluminum, copper or other metals. The tube support arm is adapted for connection to the remote water supply, and is also connected to the lower end of the snow making tower for conveying water under pressure to the snow tower and for otherwise supporting the tower. Accordingly, water under pressure supplied from a remote water source first must travel through the support arm tubing thereby warming the support arm to prevent ice buildup. Also the water is thereby cooled in subfreezing ambient atmospheric conditions prior to being conveyed to the snow tower and snow making nozzles of the snow tower.

The support arm tubing is configured in the form of an elongated inverted U having two legs with bottom and top ends and an upper cross conduit connected between the legs at the upper ends. The bottom end of one of the legs is adapted for connection to the remote water source, and a water outlet is provided on the other bottom end of the legs for supplying water to the snow tower water supply conduit.

Accordingly, the supply water travels first through the tubular support arm is thereby precooled, not only by contact of the metallic tubing with the subfreezing ambient atmosphere, but also due to evaporative cooling effects created by condensation or water which accumulates on the outer surface of the tubular support arm. In fact, these combined cooling effects could theoretically be sufficient to bring the internal temperature of the water down to the freezing point, which of course would be extremely desirable when manufacturing snow. The colder supply water provides a better quality of snow at higher subfreezing ambient temperatures.

Well water used for snow making is generally 49° to 50° F. and lake bottom water is generally around 40° F. Ideally, the water used for making snow should be just above freezing, for example, 32.5° F., in order to produce the best quality snow at maximum quantities. The cooling effects of the tubing support arm of the present invention provides the capability of precooling the water supply toward the 32.5° F. temperature limit, depending upon the subfreezing ambient conditions, in order to provide a snow tower which manufactures snow at maximum efficiency with the greatest possible quality.

More importantly, the support arm is warmed by the water passing therethrough thereby preventing ice and snow accumulation.

The support arm tubing is also provided with a drain passage that communicates the bottom interior ends of the tubing for draining water from the tubing when not in use. If the drain passage were not provided, water would of course accumulate in one of the legs of the support arm and then freeze and damage the tubing when not is use. This drain passage is made smaller in cross sectional area than the water outlet of the support arm to make certain that the vast majority of the water supplied will circulate through the entire tubing of the support arm, as opposed to passing through the drain passage.

The tubing support arm is also designed to be provided with two water outlets on one leg thereof whereby one outlet is positioned above the other. This permits selective vertical positioning and connection of the snow tower to the support arm. In other words, the snow tower may be supported by the support arm such that the bottom end of the snow tower connects to the lower water supply outlet, or the lower end of the snow tower may be supported at a higher position on the support arm whereby the water supply conduit at the bottom end of the snow tower is connected to the upper water outlet on the support arm, instead of the lower water outlet. When the snow tower is connected to one or the other of the water outlets, the water outlet not being used at the time is normally capped or plugged off.

Alternatively, when the upper water outlet on the support arm is being utilized, such that the snow tower is raised to its highest possible position off the ground in order to thereby also raise the nozzles to the maximum extent off of the ground, then the bottom water outlet on the support arm may be connected to an additional water nozzle mechanism which sprays water into the ambient atmosphere to make additional snow under subfreezing conditions of 15° F. or less.

This selective vertical positioning of the snow tower on the support arm permits the snow tower with its support arm to be shipped to location at a minimum height or length. However, when assembling the adjustable snow tower on location, the snow tower can be extended out to maximum on the support arm to thereby raise the snow making nozzles to maximum height above the ground, thereby providing maximum loft and dwell time, which contributes to the manufacture of quality snow.

The water warmed support arm is preferably used in combination with the inventor's water warmed tower structure of the type disclosed in U.S. Pat. No. 3,822,825 so that the entire tower structure is free from ice and snow buildup or accumulation thereon. Additionally, the tower is virtually maintenance free during operation and thereby labor saving.

BRIEF DESCRIPTION OF THE DRAWINGS

Other objects and advantages appear in the following description and claims.

The accompanying drawings show, for the purpose of exemplification, without limiting the invention or the claims thereto, certain practical embodiments illustrating the principals of this invention wherein:

DETAILED DESCRIPTION OF A PREFERRED EMBODIMENT

Figure 1:
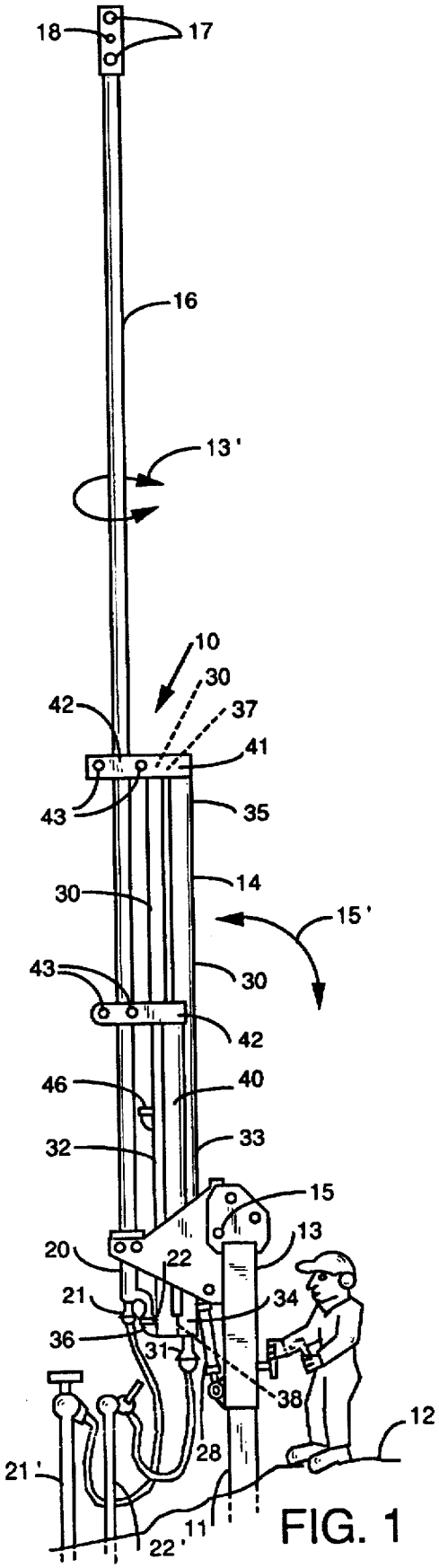
FIG. 1 is a view in side elevation of the adjustable snow making tower of the present invention with the snow tower shown in its lowest position as supported by its support arm.

With the exception of the make-up or construction of support arm 14, the adjustable snow making tower 10 of the present invention operates identical to the inventor's adjustable snow making tower shown and described in U.S. Pat. No. 5,360,163, the description of which is accordingly incorporated here by reference.

The adjustable snow making tower 10 is comprised of a substantially vertical support pole 11 (which may be a conventional steel pipe of, for example, 4½ inches in outer diameter) having its bottom end anchored into the ground surface 12.

A support pipe 13 is coaxially received over support pole 11 for support thereon and free axial rotation thereon for a full 360° as particularly indicated by arrow 13'.

The support arm 14, wherein the principal features of the present invention reside, is pivotally connected at its bottom end at pivot pin 15, which is positioned adjacent the upper end of support pipe 13. This permits the support arm 14 to pivotally rotate substantially from horizontal to vertical as indicated in FIG. 1 by arrow 15'.

Elongated pipe snow making tower 16, which extends, for example, from 40 to 50 feet above the ground, is constructed of aluminum alloy pipe and is provided with water discharge nozzles 17 and air discharge nozzles 18 at its upper end for respective discharge of water and air under pressure into the ambient atmosphere for manufacturing snow in subfreezing conditions. However, it should be remembered that the present invention is not limited to snow making towers which externally mix the air and water discharge. The present invention is also applicable to snow towers wherein the water and air are internally mixed before discharge into the atmosphere. In fact, the present invention is applicable to most any type of snow making apparatus, even snow-guns, which are elevated and manipulated by the tower structure of the present invention.

Supply connections are also provided at the lower end 20 of tower 16 for supplying air and water under pressure to the nozzles 18 and 17 respectively through pipe tower 16. The air supply connection is indicated as a pipe quick-coupling connection 21 and the water supply connection is indicated as a quick connect pipe coupling or connection 22.

Air supply connection 21 is connected to a remote air source through the supply pipe 21'. Water connection 22 is supplied with water under pressure from a remote source from water supply pipe 22', after first being circulated through tubular support arm 14 for precooling in accordance with the teachings of the present invention.

A jack or drive mechanism 28, which is a conventional double-action hydraulic cylinder, is provided to raise and lower support arm 14, together with its supported tower 16 on support pipe 13.

As previously indicated, except for the particulars of the tubular water cooling support arm 14 of the present invention, the adjustable snow making tower 10 of the present invention operates in all respects in the similar manner to that of the inventor's aforementioned patent.

With particular reference now to the structure of support arm 14, it is constructed of heat conducting tubing, such as steel, copper or aluminum, and preferably aluminum tubing 30.

Tubing 30 is connected to water supply pipe 22' at bottom connector 31 and it is also connected for water outlet to tower 16 by coupling 22 at outlet 36.

The tubing 30 of support arm 14 is configured in the form basically of an elongated inverted U having two legs 32 and 33 with bottom and top ends 34 and 35 respectively. Bottom end 34 of leg 33 is adapted at quick coupling 31 for connection to the remote water source through pipe 22', and water outlet 36 at the bottom 34 of leg 32 is coupled to supply water under pressure to pipe tower 16 through quick disconnect coupling 22.

An upper cross conduit connection 37 provides a conduit connection between tube legs 32 and 33 to complete the inverted U structure of the support arm 14.

The support arm tubing 30 is also provided with a small drain passage 38 communicating the bottom interior ends 34 of tubing 30 for draining water from leg 32 over to leg 33 and then on downwardly and outwardly through water coupling 31 and water supply pipe 22' when the tower is not in use. This prevents water from collecting within tubing 30 and freezing and thereby bursting and damaging the conduit.

Figure 3:
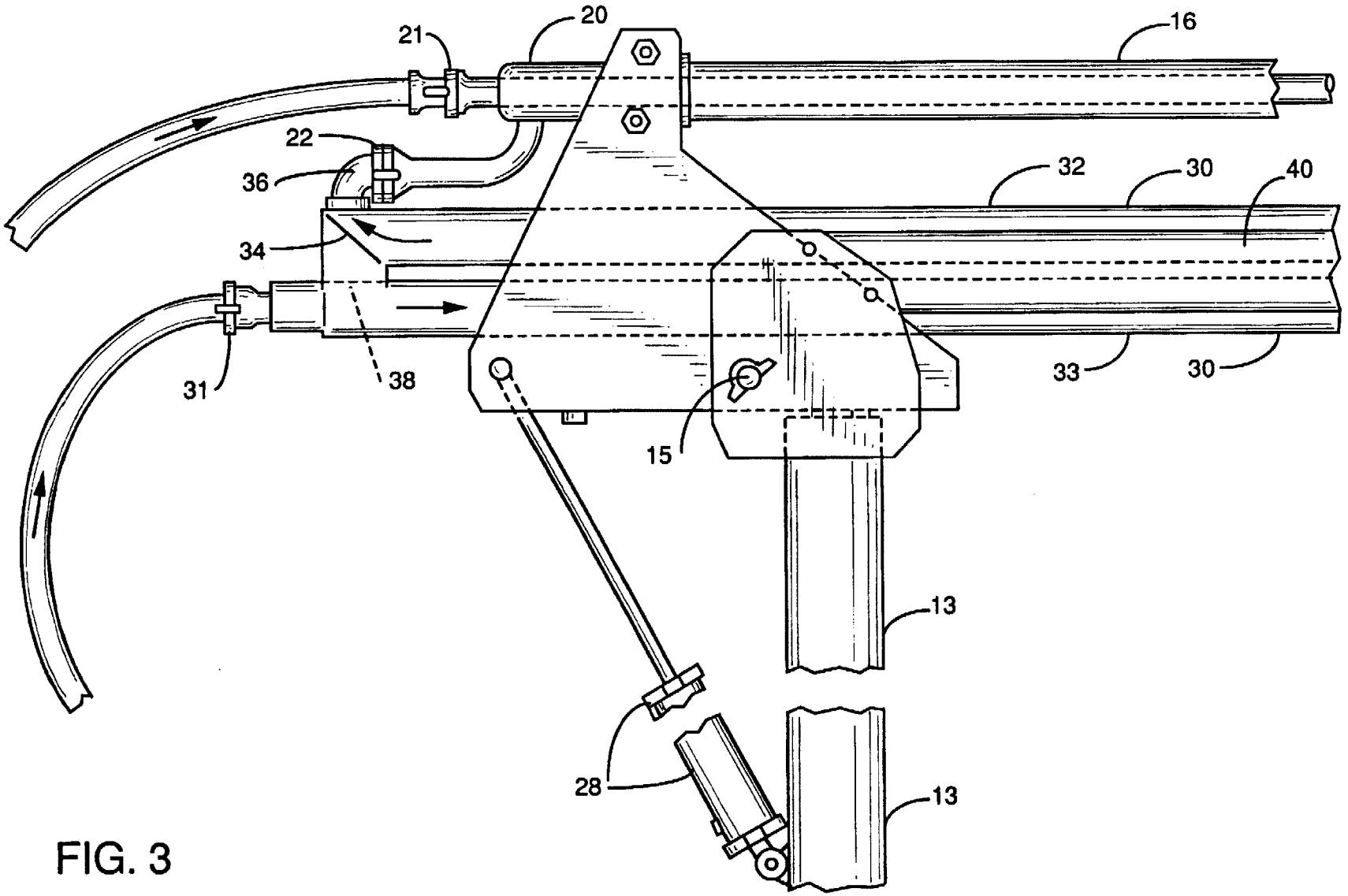
FIG. 3 is an enlarged view in side elevation showing the lower portions of the adjustable snow making apparatus of FIG. 1 with the support arm and its supported snow tower shown in the horizontal position.
Figure 4:
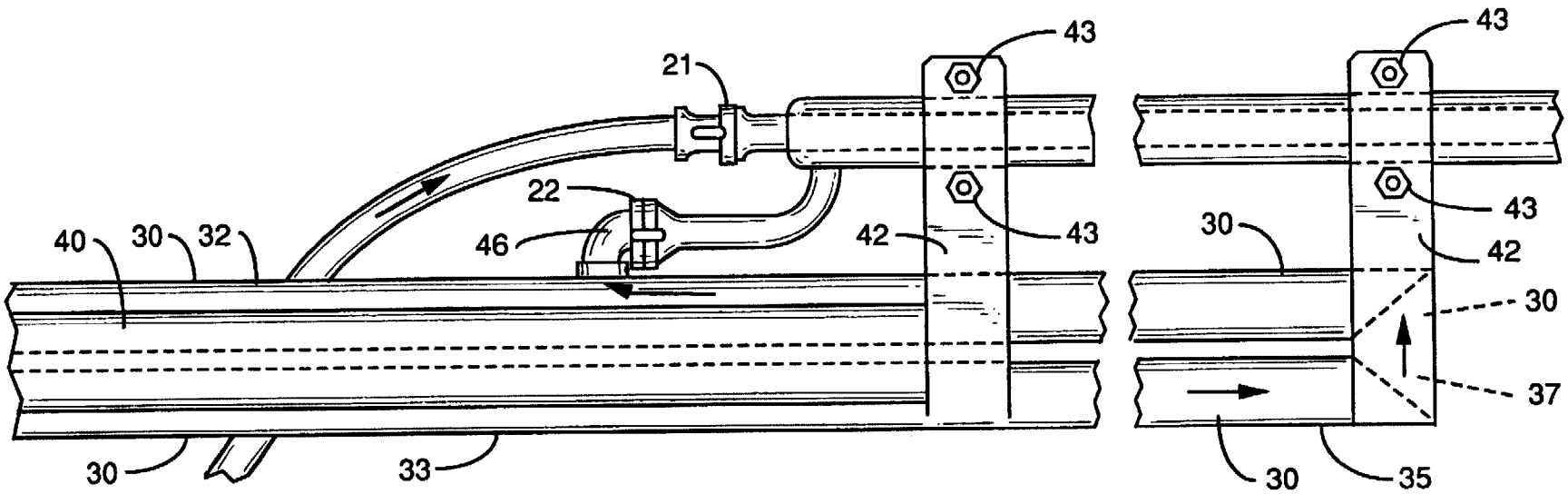
FIG. 4 is an enlarged view in side elevation showing the upper or forward most portions of the support arm and its supported snow tower of FIG. 2 as seen in the horizontal position.

The cross-sectional area of this drain passage 38 is much smaller than that of outlet 36 so that the majority of the water will be passing through conduit 30 will be forced to travel the entire length of the inverted U shaped configuration of conduit 30, instead of passing directly through drain passage 38, so that maximum cooling of the water passing through the tubing will be accomplished. These details are best illustrated in FIGS. 3 and 4.

The aluminum tubing 30 is all secured together by aluminum welds and also by aluminum side plates 40 which are also welded to the tubing 30. Upper and lower aluminum support brackets 41 and 42 respectively are also welded to tubing 30 and they protrude away therefrom to adjustably support elongated tube tower 16. Tube tower 16 is clamped in position by respective double tined or fingered brackets 41 and 42 by means of conventional clamping bolts 43, which cause the brackets to sandwich and clamp the pipe tower 16 therebetween to support the same rigidly with support arm 14 for movement therewith.

Figure 2:
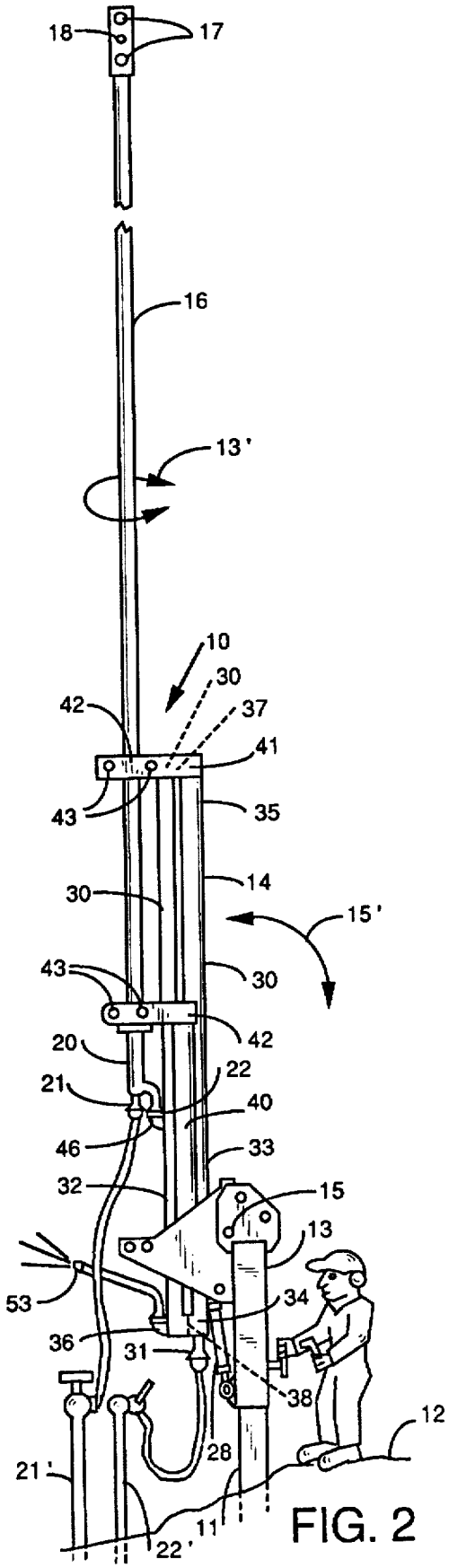
FIG. 2 is a view in side elevation of the adjustable snow making tower of the present invention showing the snow tower as secured to its support arm with the tower in its maximum extendable position.

Reference is next made to FIG. 2, which shows the identical adjustable snow making tower structure 10 as shown in FIG. 1, except that pipe tower 16 is supported from support arm 14 at a higher position.

As can be seen from FIGS. 1 and 2, there are two are water outlets 36 and 46 which are provided on leg 32 of support arm 14, with water outlet 46 being positioned above outlet 36. This permits selective vertical positioning of tower 16 relative to support arm 14.

This versatility is desirable for several reasons. First of all, it permits the tower nozzles 17 and 18 to be raised to a maximum height above ground, secondly it permits the tower to be lowered to its maximum low position relative to support arm 14 for easier shipment of the assembly to the ski slope for installation, and it also permits the connection of an extra water nozzle mechanism 53 to lower outlet 36 as indicated in FIG. 2 for spraying water as shown into the ambient atmosphere to make additional snow when the subfreezing conditions are 15° F. or less.

In FIG. 1, the upper outlet 46 is not being utilized and it is capped off. It can simply be capped off by using a conventional quick coupling cap, which operates in the same manner as the conventional quick coupling connections when the particular water outlet is utilized to supply water to tower 16.

I claim:

1. A snow making tower structure free from ice and snow buildup comprising: a substantially vertical support pole having a bottom end anchored in a ground surface, a support arm connected to said pole, snow making nozzle means secured to and supported from said support arm for elevating said nozzle means above ground, air and water supply conduit means adapted for conveying water and air under pressure to said nozzle means for discharge into ambient atmosphere through said nozzle means for manufacturing snow in subfreezing conditions, the improvement including said support arm comprised of heat conducting tubing adapted for connection to a remote water supply and connected to said water supply conduit means for conveying water under pressure to said nozzle means such that the water under pressure from said remote source travels first through said support arm tubing for warming said support arm to prevent ice and snow buildup thereon prior to said water being conveyed to said nozzle means through said conduit means, said support arm pivotally connected to said pole adjacent the upper end thereof for pivotal movement substantially from horizontal to vertical for elevating said nozzle means, said support arm tubing configured in the form of an elongated inverted U having two legs with top and bottom ends and an upper cross conduit connection between said legs at the upper ends, the bottom end of one leg adapted for connection to said remote water source and a water outlet on the other of said legs for supplying water to said conduit means.

2. The snow making tower structure of claim 1, said support arm tubing having a drain passage communicating the bottom interior ends of said tubing for draining water from said tubing when not in use, said passage being smaller in cross sectional area than said outlet.

3. The snow making tower structure of claim 2 wherein said nozzle means and said conduit means are comprised of an elongated pipe snow making tower having an upper end and a lower end with said nozzle means at the upper end of the tower and water supply connection means at the lower end of the tower for connection to said support arm outlet, said pipe tower secured at its lower end to said support arm for pivotal movement therewith.

4. The snow making tower structure of claim 3 including two of said water outlets on said other leg with one positioned above the other thereby permitting selective vertical positioning and connection of said tower to said support arm.

5. The snow making tower structure of claim 4 wherein said tower is connected to said upper water outlet of said support arm and water nozzle means is connected to said lower outlet for spraying water into ambient atmosphere to make additional snow under subfreezing conditions of 15° F. or less.

6. The snow making tower structure of claim 3 wherein said elongated pipe snow making tower includes an air conduit coextending within a metal outer water conduit whereby said tower and said support arm are warmed by the passage of water therethrough for providing an ice and snow free tower structure.

7. A snow making tower structure free from ice and snow buildup comprising: a substantially vertical support pole having a bottom end anchored in a ground surface, a support arm connected to said pole, an elongated pipe snow making tower having an upper end and a lower end with nozzle means at the upper end of the tower and water supply connection means at the lower end of the tower, said pipe tower secured to at its lower end and supported from said support arm for elevating said nozzle means above ground, air and water supply conduit means adapted for conveying water and air under pressure to said nozzle means for discharge into ambient atmosphere through said nozzle means for manufacturing snow in subfreezing conditions, the improvement including said support arm comprised of heat conducting tubing adapted for connection to a remote water supply and connected to said water supply connection means for conveying water under pressure to said nozzle means whereby the water under pressure from said remote source travels first through said support arm tubing for warming said support arm to prevent ice and snow buildup thereon prior to said water being conveyed to said nozzle means through said conduit means.

8. The snow making tower structure of claim 7 wherein said support arm is pivotally connected to said pole adjacent the upper end thereof for pivotal movement substantially from horizontal to vertical for elevating said nozzle means.

9. The snow making tower structure of claim 8, said support arm tubing configured in the form of an elongated inverted U having two legs with top and bottom ends and an upper cross conduit connection between said legs at the upper ends, the bottom end of one leg adapted for connection to said remote water source and a water outlet on the other of said legs for supplying water to said conduit means through said connection means.

10. The snow making tower structure of claim 9, said support arm tubing having a drain passage communicating the bottom interior ends of said tubing for draining water from said tubing when not in use, said passage being smaller in cross sectional area than said outlet.

11. The snow making tower structure of claim 10 including two of said water outlets as upper and lower outlets on said other leg with one positioned above the other thereby permitting selective vertical positioning and connection of said tower to said support arm.

12. The snow making tower structure of claim 11 wherein said tower is connected to said upper water outlet of said support arm and water nozzle means is connected to said lower outlet for spraying water into ambient atmosphere to make additional snow under subfreezing conditions of 15° F. or less.

13. The snow making tower structure of claim 10 wherein said elongated pipe snow making tower includes an air conduit coextending within a metal outer water conduit whereby said tower and said support arm are warmed by the passage of water therethrough for providing an ice and snow free tower structure.

* * * * *